US006367220B1

(12) United States Patent
Krause et al.

(10) Patent No.: US 6,367,220 B1
(45) Date of Patent: Apr. 9, 2002

(54) CLIP FOR SIDING PANEL

(75) Inventors: Walter M. Krause, Ashland; Jack T. Mowery, Medina; Benjamin L. McGarry, Akron, all of OH (US)

(73) Assignee: Associated Materials, Incorporated, Akron, OH (US)

( * ) Notice: Subject to any disclaimer, the term of this patent is extended or adjusted under 35 U.S.C. 154(b) by 0 days.

(21) Appl. No.: 09/497,545

(22) Filed: Feb. 3, 2000

(51) Int. Cl.[7] ..... E04D 1/34

(52) U.S. Cl. ..... 52/512; 52/520; 52/543; 52/547; 52/550

(58) Field of Search ..... 52/512, 520, 526, 52/527, 528, 543, 545, 546, 549, 551, 357, 712, 547, 550, 714; 248/301; D8/382, 371

(56) References Cited

U.S. PATENT DOCUMENTS

| | | | | |
|---|---|---|---|---|
| 1,232,196 | A | | 7/1917 | Brague |
| 1,674,210 | A | | 6/1928 | Loucks |
| 1,775,937 | A | | 9/1930 | Keller |
| 1,813,798 | A | | 7/1931 | Gerosa |
| 1,941,216 | A | | 12/1933 | McKeown |
| 2,126,676 | A | | 8/1938 | Thomas |
| 2,141,861 | A | | 12/1938 | Hahn et al. |
| 2,174,145 | A | | 9/1939 | Tummins |
| 2,293,744 | A | | 8/1942 | Miles et al. |
| 2,831,222 | A | | 4/1958 | Anderson |
| 3,226,901 | A | | 1/1966 | Harter |
| 3,233,382 | A | | 2/1966 | Graveley, Jr. |
| 3,282,009 | A | | 11/1966 | Chalmers |
| 3,418,777 | A | | 12/1968 | Gillis |
| 3,438,168 | A | | 4/1969 | Tischuk |
| 3,504,467 | A | | 4/1970 | Hatch et al. |
| 3,520,099 | A | | 7/1970 | Mattes |
| 3,711,137 | A | | 1/1973 | Tinnerman |
| 3,738,076 | A | | 6/1973 | Kessler |
| 3,757,483 | A | | 9/1973 | Torbett |
| 3,969,866 | A | | 7/1976 | Kyne |
| 3,999,348 | A | | 12/1976 | Hicks |
| 4,186,538 | A | | 2/1980 | Marcum, Jr. |
| 4,255,914 | A | | 3/1981 | Seipos |
| 4,272,938 | A | | 6/1981 | Seipos |
| 4,296,580 | A | | 10/1981 | Weinar |
| 4,327,528 | A | | 5/1982 | Fritz |
| 4,348,849 | A | | 9/1982 | Wollam et al. |
| 4,356,673 | A | | 11/1982 | Gailey |
| 4,382,354 | A | | 5/1983 | Gailey et al. |
| 4,435,933 | A | | 3/1984 | Krowl |
| 4,435,938 | A | | 3/1984 | Rutkowski et al. |
| 4,498,272 | A | | 2/1985 | Adams |
| 4,575,983 | A | | 3/1986 | Lott, Jr. et al. |
| 4,596,094 | A | | 6/1986 | Teller et al. |
| 4,646,501 | A | | 3/1987 | Champagne et al. |
| 4,669,238 | A | | 6/1987 | Kellis et al. |
| 4,698,942 | A | | 10/1987 | Swartz |
| 4,856,744 | A | * | 8/1989 | Frankel ..... 248/215 |
| 4,947,609 | A | | 8/1990 | Champagne |
| D316,810 | S | | 5/1991 | Blackford |
| 5,058,358 | A | | 10/1991 | Stratton |
| 5,127,205 | A | * | 7/1992 | Eidson ..... 52/520 |
| 5,150,555 | A | | 9/1992 | Wood |
| 5,339,608 | A | | 8/1994 | Hollis et al. |
| 5,526,553 | A | * | 6/1996 | Klein ..... 24/295 |
| 5,622,020 | A | | 4/1997 | Wood |

* cited by examiner

*Primary Examiner*—Carl D. Friedman
*Assistant Examiner*—Jennifer I. Thissell
(74) *Attorney, Agent, or Firm*—Banner & Witcoff, Ltd.

(57) ABSTRACT

A clip for a siding panel includes a planar sheet of material, a first leg, and a second leg. The first leg extends outwardly from the planar sheet, and bends downwardly and inwardly toward the planar sheet to form a U-shaped flange defining a channel opening toward the planar sheet. The second leg extends outwardly from the sheet at a position below the first leg. The first leg is configured to mate with a channel nailing hem of a siding panel. The second leg is configured to mate with a channel formed in a top lock of the siding panel. In some preferred embodiments, another first leg is spaced apart from the first leg, with the second leg being positioned between the two first legs.

20 Claims, 3 Drawing Sheets

CLIP FOR SIDING PANEL

INTRODUCTION

The present invention is directed to a clip for a siding panel, and, more particularly, to a clip for securing a siding panel, having a channel nailing hem, to a structure, while allowing longitudinal movement of the siding panel.

BACKGROUND

Siding composed of vinyl or other material is commonly used as an external covering of a structure. Such siding is typically formed of elongate panels having connectors formed along the lengths of their upper and lower edges. In use, the siding panels are installed in horizontal rows and interlock with vertically adjacent panels. A nailing hem extending across the top of each siding panel has a series of slots for receiving nails to attach the siding panel to a structure. The siding expands and contracts with changes in temperature, and the slots allow the siding to move longitudinally along the structure.

Ideally, siding nails are not driven fully into the wall of the structure so that the underside of the nail head does not bear against the nailing hem with any significant pressure. This allows for the longitudinal movement of the panel along the structure. However, the nails may be driven in too far, impeding the free movement of the siding panel.

In certain installations, horizontally adjacent panels are rigidly secured to one another with a splicing member positioned behind the panels. This can create a composite siding panel of great length. The slots in the nailing hem cannot accommodate the longitudinal expansion of such a composite siding panel.

It is an object of the present invention to provide a siding clip which reduces or wholly overcomes some or all of the aforesaid difficulties inherent in prior known devices. Particular objects and advantages of the invention will be apparent to those skilled in the art, that is, those who are knowledgeable or experienced in this field of technology, in view of the following disclosure of the invention and detailed description of preferred embodiments.

SUMMARY

The principles of the invention may be used to advantage to provide a clip for securing an interlocking siding panel, having a channel nailing hem, to a structure, while allowing longitudinal movement of the siding panel. The clip may be used in conjunction with a splicing member which rigidly secures horizontally adjacent siding panels to one another.

As is common in the siding industry, the clip and siding panels described herein can be composed of a variety of materials, including metal and plastic, e.g. PVC. Preferably, the clip is composed of aluminum.

In accordance with a first aspect, a clip for a siding panel includes a planar sheet of material. A forward leg extends outwardly from a front surface of the planar sheet, forming a shoulder, and then bends downwardly and inwardly forming a U-shaped flange defining a channel opening toward the planar sheet. A rear leg extends outwardly from the front surface of the planar sheet at a point below the forward leg.

In accordance with another aspect, a siding panel assembly includes a siding panel comprising a top lock, a body portion, a bottom lock, and a nailing hem. The bottom lock and top lock are configured to enable interlocking with other panels of like construction. The nailing hem includes a channel base, opposing channel side portions, and a channel having an open end. The assembly also includes a clip formed of a planar sheet having an upper edge and a lower edge. A forward leg extends from a front surface of the planar sheet. A first portion of the forward leg extends forwardly, and a second portion of the forward leg bends downwardly and inwardly forming a U-shaped flange defining a channel opening toward the planar sheet. The U-shaped flange is configured to mate with the nailing hem. A rear leg extends outwardly from the planar sheet below the forward leg. The rear leg is received by the top lock.

In accordance with yet another aspect, a clip for a siding panel includes a planar sheet of material, and a first leg extending outwardly from a surface of the planar sheet to form a shoulder. The first leg then bends back toward the planar sheet forming a U-shaped flange defining a channel opening toward the planar sheet. A second leg extends outwardly from the surface of the planar sheet at a point below the first leg.

In accordance with a further aspect, a clip for a siding panel includes a planar sheet of material folded upon itself to form an upper folded edge and forward and rearward legs. A lower portion of the forward leg extends forwardly from the forward leg, forming a shoulder, and then bends downwardly and inwardly forming a U-shaped flange defining a channel opening toward the forward leg. A lower portion of the rearward leg bends forwardly at a horizontal bend forming a shoulder extending outwardly from the rearward leg.

From the foregoing disclosure, it will be readily apparent to those skilled in the art, that is, those who are knowledgeable or experienced in this area of technology, that the present invention provides a significant advance. Preferred embodiments of the clip of the present invention can provide a device which safely secures a siding panel to a structure while allowing longitudinal movement of the panel along the structure. These and additional features and advantages of the invention disclosed here will be further understood from the following detailed disclosure of preferred embodiments.

BRIEF DESCRIPTION OF THE DRAWINGS

Preferred embodiments are described in detail below with reference to the appended drawings.

Figure 1:
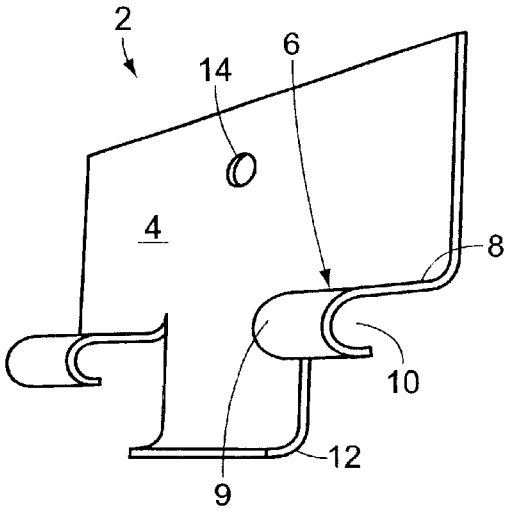
FIG. 1 is a perspective view of a preferred embodiment of the siding clip of the present invention.

The figures referred to above are not drawn necessarily to scale and should be understood to present a representation of the invention, illustrative of the principles involved. Some features of the clip depicted in the drawings have been enlarged or distorted relative to others to facilitate explanation and understanding. The same reference numbers are used in the drawings for similar or identical components and features shown in various alternative embodiments. Clips for siding panels as disclosed herein, will have configurations and components determined, in part, by the intended application and environment in which they are used.

DETAILED DESCRIPTION OF PREFERRED EMBODIMENTS

The present invention pertains to a clip for slidably securing siding panels to a structure. The clip and the panels are typically composed of metal or plastic, e.g., PVC, but are not intended to be so limited, and may be formed of any suitable material. In a preferred embodiment, the clip is made of aluminum. The clip allows siding panels to be safely secured to a building or other structure, while providing horizontal, or longitudinal, movement of the panels, thereby allowing for thermal expansion and contraction of the siding panels.

Figure 2:
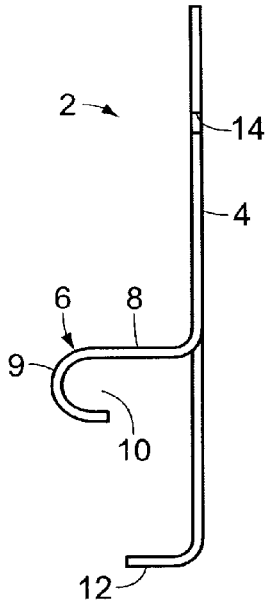
FIG. 2 is a side elevation of the siding clip of FIG. 1.

As shown in FIGS. 1 and 2, a clip 2 in accordance with the invention comprises a planar sheet of material 4. A pair of forward legs 6 are each formed by bending a lower portion of planar sheet 4 outwardly to form a shoulder 8 extending outwardly from the planar sheet. In a preferred embodiment, shoulder 8 extends perpendicular to planar sheet 4. Forward legs 6 are then bent downwardly and inwardly with respect to the planar sheet 4, forming a U-shaped flange 9 defining a channel 10 opening toward the planar sheet 4. A lower portion of planar sheet 4, positioned between and below forward legs 6, is bent outwardly to form a rearward leg 12. Rearward leg 12 preferably extends perpendicular to planar sheet 4. An aperture 14 is formed in planar sheet 4 above forward legs 6 to receive a fastener, such as a nail, for securing clip 2 to a structure.

Clip 2 is configured to secure a siding panel, having a channel nailing hem, to a structure. A siding panel having a channel nailing hem is disclosed in commonly owned application Ser. No. 09/321,739, entitled "Interlocking Panel With Channel Nailing Hem," filed on May 28, 1999, the entire disclosure of which is incorporated herein by reference for all purposes.

Figure 3:
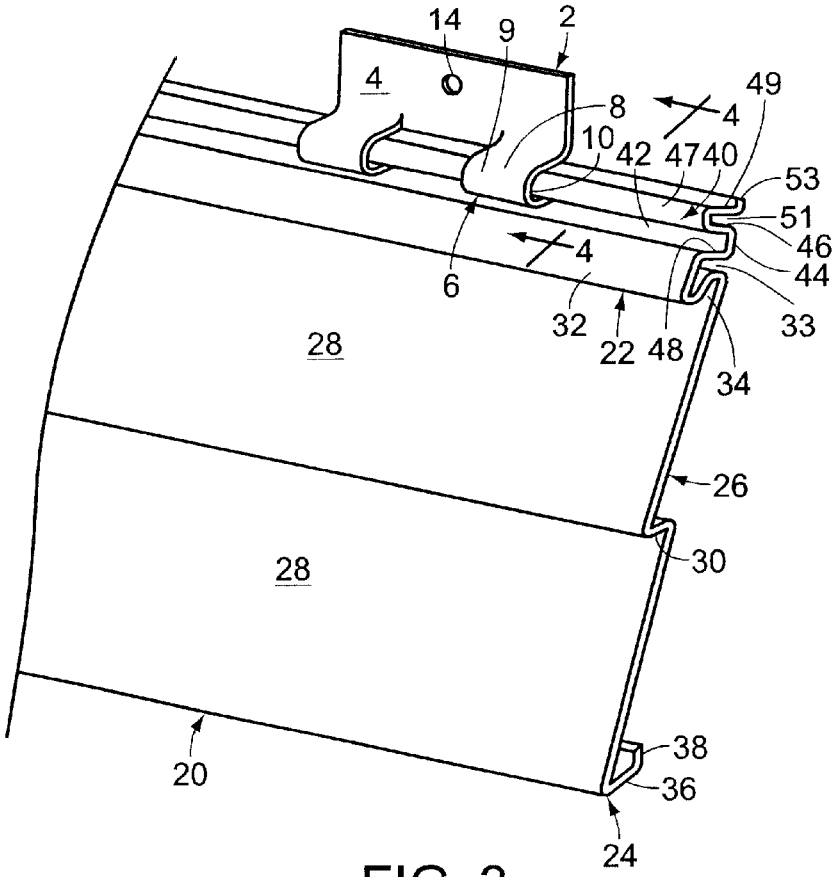
FIG. 3 is a perspective view of the siding clip of FIG. 1, shown attached to a siding panel having a channel nailing hem.

As seen in FIG. 3, a siding panel 20 has a top lock 22, a bottom lock 24, and a body portion 26. Body portion can have a wide variety of configurations, but preferably includes a pair of declinations 28 separated by a horizontal ledge or shoulder 30. A declination, as used herein, refers to a substantially planar portion of a siding panel which slopes downwardly and slightly outwardly with respect to the panel. The declinations combine with the horizontal shoulder to form a clapboard profile for the siding panel. It is to be appreciated that in other preferred embodiments, siding panel 20 may have one or more than two declinations 28.

Figure 4:
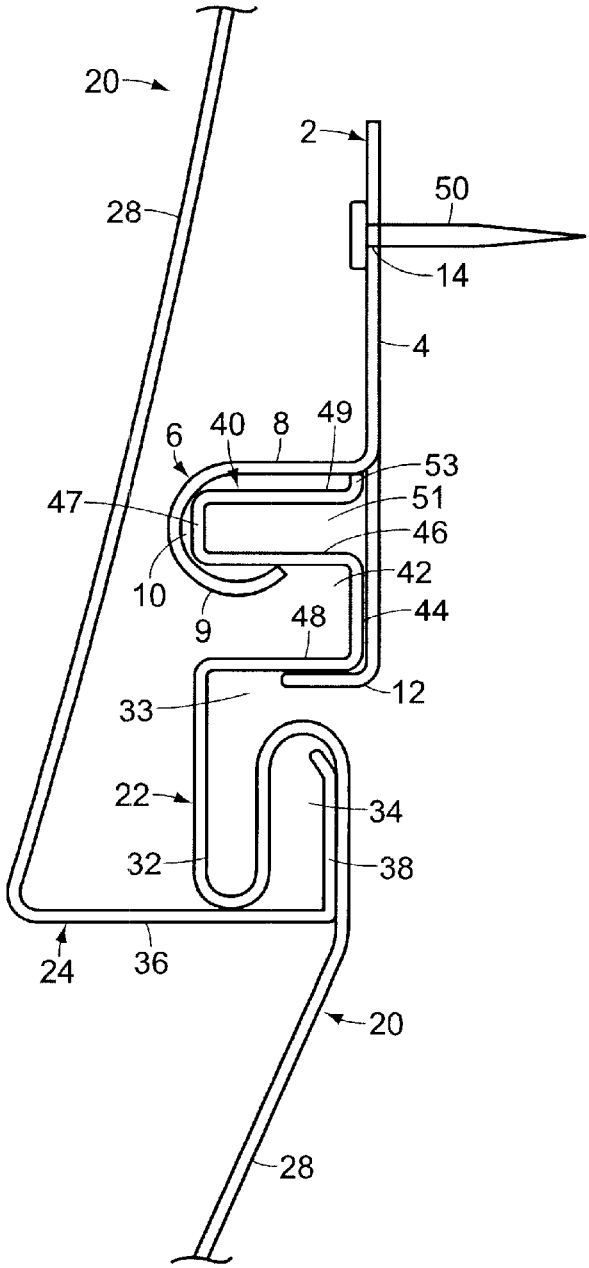
FIG. 4 is a fragmentary side elevation of the siding clip of FIG. 1, shown attached to a channel nailing hem of a first siding panel, and a second siding panel interlocked with the first siding panel.

The top and bottom locks can also have a wide range of shapes. Top and bottom locks 22, 24 have complimentary shapes so that vertically adjacent siding panels can be interlocked, as seen in FIG. 4. In a preferred embodiment, top lock 22 is bent to form a dogleg protrusion 32 which extends downwardly over siding panel 20 forming a rearwardly opening channel 33 and a downwardly opening channel 34. Bottom lock 24 has a shoulder 36 extending inwardly from a lower edge of body portion 26 and terminates in a lip 38 extending upwardly from a rear edge of shoulder 36. When a pair of vertically adjacent siding panels are interlocked, top lock 22 of the lower siding panel 20 interlocks with bottom lock 24 of the upper siding panel 20. Shoulder 36 of the upper siding panel 20 is positioned beneath protrusion 32 of the lower siding panel 20 and lip 38 of the upper siding panel is received by channel 34 of the lower siding panel.

Siding panel 20 has a channel nailing hem 40 provided above top lock 22. Nailing hem 40 includes a channel 42 defined by a channel base 44 and channel sides 46 and 48. Channel sides 46,48 are generally parallel to one another and channel 42 is open to one end opposite channel base 44. The upper portion of nailing hem 40 includes a flange 47 extending upwardly from the outer edge of channel side 46. Shoulder 49 extends rearwardly from flange 47 and terminates in upwardly extending lip 53. Channel side 46, flange 47 and shoulder 49 form a rearwardly opening channel 51.

In use, as seen in FIGS. 3 and 4, a clip 2 is snap-fit with channel nailing hem 40 from the front of siding panel 20. In contrast to prior art clips, each of which must be slid onto a siding panel from the end of the panel before the panel is ready to be installed, clip 2 can be carried by an installer and placed on panel 20 at any desired location. This provides an installer with the flexibility of selecting a spot on the panel at which a clip is required, while the panel is in place on a structure, eliminating the need to determine ahead of time exactly how many clips will be needed for a particular panel. Therefore, considerable time and expense savings can be realized in the situation where it is determined, after the panel is in place, that another clip is required. Without the capability of installing a clip while the panel is in place, the installer would need to access the end of the panel to slide another clip on, which might entail taking the panel down from the structure.

Clip 2 is installed from the front of siding panel 20 by temporarily locating rearward leg 12 in channel 51 at a desired position along the length of siding panel 20. The top of clip 2 is then tilted forwardly, and as forward legs 6 snap onto nailing hem 40, rearward leg 12 slides out of channel 51. Clip 2 is then tilted rearwardly, allowing forward legs 6 to rotate about channel side wall 46, flange 47 and shoulder 49 of nailing hem 40. As clip 2 rotates, rear leg 12 slides into channel 33. Thus, rear leg 12 is received by channel 33 and forward leg 6 interlocks with nailing hem 40. Specifically, flange 9 of each forward leg 6 wraps around nailing hem 40, such that channel side wall 46, flange 47 and shoulder 49 are received by channel 10 of clip 2, and flange 9 is partially received by channel 42 of nailing hem 40. Clip 2 is then securely fastened to a structure by a nail 50, or any other suitable fastener. Therefore, clip 2 safely secures siding panel 20 to a structure, but advantageously allows the siding panel to slide longitudinally along clip 2, providing for expansion and contraction of the siding panel 20.

Figure 5:
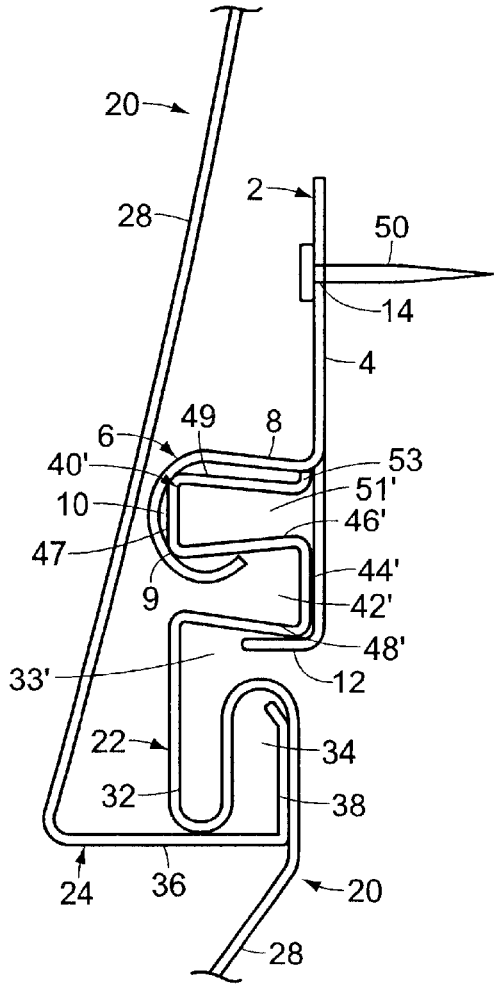
FIG. 5 is a fragmentary side elevation of the siding clip of FIG. 1, shown attached to a first siding panel having a channel nailing hem with a trapezoidal configuration, and a second siding panel interlocked with the first siding panel.

FIG. 5 shows a clip 2 interlocked with a siding panel 20' having a nailing hem of a different configuration. Nailing hem 40' has a trapezoidal cross-section comprising channel base 44 forming the wide base of the trapezoid, with channel sides 46', 48' being angled to form the converging sides of the trapezoid. The narrower end of the trapezoid forms the open end of channel 42'. Consequently, channel 51' has a trapezoidal shape as well. Clip 2 interlocks with nailing hem 40' in the manner described above with respect to nailing hem 40. While the embodiments of the channel nailing hem discussed herein include the rectangular and trapezoidal cross-sections, other cross-sectional shapes of the channel nailing hem which would interlock with the clip are contemplated to be within the scope of the present invention.

As disclosed in U.S. application Ser. No. 09/321,739, the nailing hem and/or top lock of the siding panel may be reinforced to provide added rigidity for the siding panel. The clip of the present invention will interlock with such a reinforced siding panel in the same manner as described above.

Figure 6:
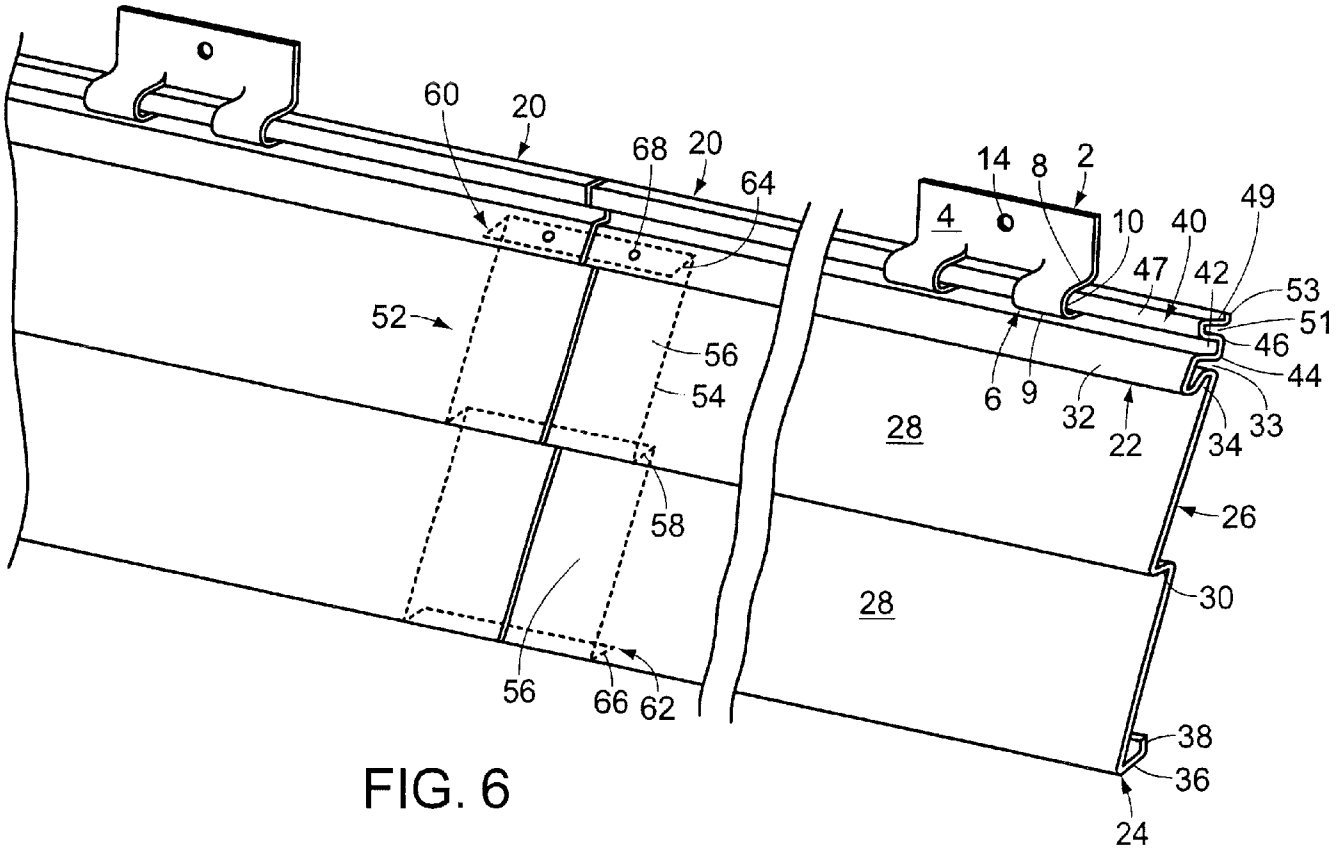
FIG. 6 is a perspective view, shown partially broken away, of two horizontally adjacent siding panels secured to one another with a splicing member, and a siding clip of FIG. 1 attached to each of the siding panels.

FIG. 6 illustrates the use of clip 2 with a pair of horizontally adjacent siding panels secured to one another with a splicing member. A splicing member is disclosed in commonly owned application Ser. No. 09/122,333, entitled "Splicing Member for Siding Panels," filed on Jul. 24, 1998, the entire disclosure of which is incorporated herein by reference for all purposes.

Splicing member 52 comprises a body portion 54. Body portion 54 has a shape configured to match that of the horizontally adjacent siding panels 20 behind which splicing member 52 is positioned. In the illustrated embodiment, body portion 54 includes two declinations 56 separated by a shoulder 58. Splicing member 52 further includes a splicer top lock 60 and a splicer bottom lock 62. Top and bottom locks 60, 62 are configured to interlock with and engage top and bottom locks 22, 24, respectively, of siding panels 20. In the illustrated embodiment, top lock 60 comprises a shoulder 64 extending forwardly from a top edge of splicing member 52, and bottom lock 62 comprises a shoulder 66 extending rearwardly from a lower edge of splicing member 52. Shoulder 64 is received in channels 33 of top locks 22 of siding panels 20, and shoulder 66 is nested within bottom locks 24 of siding panels 20. Splicing member 52 is rigidly secured to siding panels 20 by fasteners 68. Fasteners 68 may be rivets, screws, adhesive, or other mechanical fasteners. In other preferred embodiments, splicing member 52 may be secured to siding panels 20 by welding or other suitable fastening means.

When siding panels 20 are rigidly secured to one another in this manner through the use of splicing member 52, a composite siding panel is created which can have a great length. Such an extended length panel will have significant thermal expansion and contraction. Clips 2 advantageously allow the longitudinal movement of siding panels 20 while ensuring that the panels are securely fastened to a structure.

Figure 7:
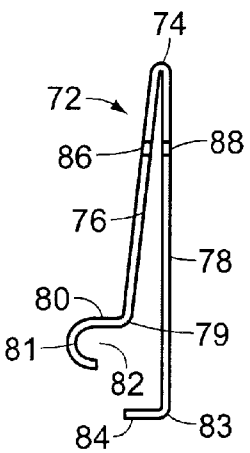
FIG. 7 is a side elevation of an alternative embodiment of a siding clip of the present invention.

Another embodiment of the clip of the present invention is shown in FIG. 7. Clip 72 is formed of a planar sheet of material folded upon itself, forming upper folded edge 74 and forward leg 76 and rearward leg 78 depending from upper folded edge 74. A lower portion of forward leg 76 is folded outwardly at horizontal bend 79, forming shoulder 80, and then downwardly and inwardly to form U-shaped flange 81 defining channel 82 opening toward rearward leg 78. In a preferred embodiment, shoulder 80 extends perpendicular to forward leg 76. Rearward leg 78 is bent forwardly at horizontal bend 83 to form shoulder 84. In a preferred embodiment, shoulder 84 extends perpendicular to rearward leg 78. Apertures 86, 88 are formed in forward and rearward legs 76, 78, respectively, to receive a nail or other suitable fastener.

While the embodiments described herein are directed to clips for siding panels extending horizontally along a wall of a structure and having a top lock and a bottom lock, it is contemplated within the scope of the invention to apply the clips to siding panels that may be differently oriented when installed. Broadly, the clips will slidably secure siding panels having first and second edge structures and a channel nailing hem located between the edge structures.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

We claim:

1. A clip for a siding panel, comprising:

a planar sheet of material;

a forward leg extending outwardly from a front surface of the planar sheet at a point below a top edge of the planar sheet forming a shoulder and then bending downwardly and inwardly forming a U-shaped flange defining a channel opening toward the planar sheet; and a rear leg extending outwardly from the front surface of the planar sheet at a point below the forward leg.

2. The clip according to claim 1, wherein the shoulder extends perpendicular to the planar sheet.

3. The clip according to claim 1, wherein the rear leg extends perpendicular to the planar sheet.

4. A clip for a siding panel, comprising:

a planar sheet of material;

a forward leg extending outwardly from a front surface of the planar sheet at a point below a top edge of the planar sheet forming a shoulder and then bending downwardly and inwardly forming a U-shaped flange defining a channel opening toward the planar sheet;

a rear leg extending outwardly from the front surface of the planar sheet at a point below the forward leg; and another forward leg extending outwardly from the front surface of the planar sheet at a point below a top edge of the planar sheet forming another shoulder and then bending downwardly and inwardly forming another U-shaped flange defining another channel opening toward the planar sheet.

5. A clip for a siding panel, comprising:

a planar sheet of material;

a forward leg extending outwardly from a front surface of the planar sheet forming a shoulder and then bending downwardly and inwardly forming a U-shaped flange defining a channel opening toward the planar sheet;

a rear leg extending outwardly from the front surface of the planar sheet at a point below the forward leg;

another forward leg extending outwardly from the front surface of the planar sheet forming another shoulder and then bending downwardly and inwardly forming another U-shaped flange defining another channel opening toward the planar sheet;

wherein the two forward legs are spaced from one another and the rear leg is positioned between the two forward legs.

6. The clip according to claim 5, further comprising an aperture formed in the planar sheet above the forward legs for receiving a fastener.

7. A clip for a siding panel, comprising:

a planar sheet of material;

a forward leg extending outwardly from a front surface of the planar sheet forming a shoulder and then bending downwardly and inwardly forming a U-shaped flange defining a channel opening toward the planar sheet;

a rear leg extending outwardly from the front surface of the planar sheet at a point below the forward leg; and an aperture formed in the planar sheet above the forward leg for receiving a fastener.

8. The clip according to claim 1, wherein the clip is made of aluminum.

9. A siding panel assembly comprising:

a siding panel comprising a top lock;

a body portion;

a bottom lock, the bottom lock and top lock configured to enable interlocking with other panels of like construction; and a nailing hem comprising a channel base;

opposing channel side portions; and a channel having an open end; and a clip comprising a planar sheet of material;

a pair of forward legs extending from a front surface of the planar sheet, a first portion of each forward leg extending outwardly from the planar sheet and a second portion of each forward leg bending downwardly and inwardly forming a U-shaped flange defining a channel opening toward the planar sheet, the U-shaped flanges configured to mate with the nailing hem; and a rear leg extending outwardly from the planar sheet below the forward legs, the rear leg being received by the top lock.

10. The siding assembly according to claim 9, further comprising:

another siding panel comprising a top lock;

a body portion;

a bottom lock, the bottom lock and top lock configured to enable interlocking with other siding panels of like construction; and a nailing hem comprising a channel base;

opposing channel side portions; and a channel having an open end;

wherein the other siding panel is positioned horizontally adjacent the siding panel; and a splicer comprising a body portion;

a top splicer lock; and a bottom splicer lock, the top and bottom splicer locks configured to interlock and engage with respective top and bottom locks of the horizontally adjacent siding panels;

wherein the splicer is positioned behind and is fastened to the horizontally adjacent siding panels.

11. The siding assembly according to claim 10, wherein the top splicer lock comprises a flange extending forwardly from an upper edge of the body portion of the splicer, the flange nesting in a channel formed in a rear surface of the top locks of the horizontally adjacent siding panels.

12. The siding assembly according to claim 10, wherein the bottom splicer lock comprises a shoulder extending rearwardly from a lower edge of the body portion, the shoulder nesting in the bottom locks of the horizontally adjacent siding panels.

13. A clip for a siding panel, comprising:

a planar sheet of material;

a first leg extending outwardly from a surface of the planar sheet at a point below a top edge of the planar sheet forming a shoulder and then bending back toward the planar sheet forming a U-shaped flange defining a channel opening toward the planar sheet; and a second leg extending outwardly from the surface of the planar sheet at a point below the first leg.

14. A clip for a siding panel, comprising:

a planar sheet of material;

a first leg extending outwardly from a surface of the planar sheet at a point below a top edge of the planar sheet forming a shoulder and then bending back toward the planar sheet forming a U-shaped flange defining a channel opening toward the planar sheet;

a second leg extending outwardly from the surface of the planar sheet at a point below the first leg; and another first leg extending outwardly from a surface of the planar sheet at a point below a top edge of the planar sheet forming another shoulder and then bending back toward the planar sheet forming another U-shaped flange defining another channel opening toward the planar sheet.

15. The clip according to claim 13, wherein the clip is made of PVC.

16. A clip for a siding panel, comprising:

a planar sheet of material folded upon itself to form an upper folded edge and forward and rearward legs;

a lower portion of the forward leg extending forwardly from the forward leg forming a shoulder and then bending downwardly and inwardly forming a U-shaped flange defining a channel opening toward the forward leg;

a lower portion of the rearward leg bending forwardly at a horizontal bend forming a shoulder extending outwardly from the rearward leg.

17. The clip according to claim 16, wherein the shoulder of the forward leg extends perpendicular to the forward leg.

18. The clip according to claim 16, wherein the shoulder of the rearward leg extends perpendicular to the rearward leg.

19. The clip according to claim 1, wherein the clip is made of PVC.

20. The clip according to claim 13, wherein the clip is made of aluminum.

* * * * *